US006710243B2

(12) United States Patent
Kao

(10) Patent No.: US 6,710,243 B2
(45) Date of Patent: Mar. 23, 2004

(54) STRUCTURE OF SIGNAL LINE

(75) Inventor: Shih-Chieh Kao, San Diego, CA (US)

(73) Assignee: Capativa Tech, Inc., San Diego, CA (US)

( * ) Notice: Subject to any disclaimer, the term of this patent is extended or adjusted under 35 U.S.C. 154(b) by 64 days.

(21) Appl. No.: 10/180,037

(22) Filed: Jun. 27, 2002

(65) Prior Publication Data

US 2004/0000417 A1 Jan. 1, 2004

(51) Int. Cl.[7] ..... H01B 11/02

(52) U.S. Cl. ..... 174/36; 174/47; 174/113 C; 174/116

(58) Field of Search ..... 174/36, 47, 113 R, 174/113 C, 116, 131 A, 106 R, 115, 129 R, 133 R

(56) References Cited

U.S. PATENT DOCUMENTS 3,483,313 A * 12/1969 Schaffhauser ..... 174/101.5
4,336,415 A * 6/1982 Walling ..... 174/47
5,939,679 A * 8/1999 Olsson ..... 174/113 C
6,528,730 B2 * 3/2003 Persson ..... 174/116

* cited by examiner

*Primary Examiner*—Chau N. Nguyen
(74) *Attorney, Agent, or Firm*—Troxell Law Office PLLC

(57) ABSTRACT

A structure of signal line comprising a core portion, a middle filler layer, an obscuring layer and a coating portion, the core portion is a transmission conductor with a rectangular cross section; the obscuring layer has at least a knitted metallic obscuring layer; the coating portion has at least a layer made of polyvinyl chloride composition; and the middle filler layer is comprised of a plurality of hollow tubes. The core portion is tangled with the middle filler layer to make the line stronger in addition to being flexible, so that the line will not have the core portion damaged when it is bent to deform, plus the obscuring function of the obscuring layer, the interference among a magnetic field, radio frequencies and static electricity can be reduced, thereby, attenuation rate of the line can be reduced, distortion of the line can be smaller, and high quality of the line can be obtained.

5 Claims, 5 Drawing Sheets

STRUCTURE OF SIGNAL LINE

BACKGROUND OF THE INVENTION

1. Field of the Invention

The present invention is related to a structure of signal line, and especially to a structure of signal line with high strength that renders the line itself not to deform when being bent; it is suitable particularly for use in signal transmission lines such as those for horns, power lines or the like.

2. Description of the Prior Art

In a conventional signal line such as that shown in FIG. 1, conductors "A" are enveloped in a PVC (or PE) insulation layer "B" to be entangled with another conductor enveloped in the PVC (or PE) insulation layer "B", then a filler layer "C" is used to envelop the insulation layer "B". The filler layer "C" is added thereover with a knitted metallic obscuring layer "D" which is further enveloped completely in a PVC (or PE) coating layer "E". The gap in such an improved electric line are totally filled by the filler layer "C" which envelops the PVC (or PE) insulation layer "B" therein, this can reduce transient pulsing, and can reduce the danger of melting of the PVC (or PE) insulation layer "B" when loading is increased. Although such a structure can get improvement on the defect of having a gap of the conventional signal line, it still can not completely get rid of the main defect of mutual interference induced during transmission by contact of the two conductors thereof too close to each other.

Referring to FIG. 2 showing another conventional structure of signal line, the signal line is made a tube body 1 from a PVC insulation layer, the inner wall of the tube body 1 is provided with two hollow thin pipes 2 with a space 4 therebetween, the two hollow thin pipes 2 are both extended therein a rectangular conductor 3 for effectively getting rid of the defect of mutual interference induced by being too close to each other of the two conductors 3. However, by virtue that there are only two hollow thin pipes 2 in the tube body 1, and the rest space 4 is empty, the strength of the tube body 1 is not enough, the space 4 (distance) between the two conductors 3 may change by bending, thereby the two conductors 3 not only mutually interfere with each other again, but also signal transmission may be influenced by deformation of the two conductors 3 induced by pressing on the weak hollow tube body 1. In this view, the conventional structure of signal line is not ideal either.

Therefore, the motive in study and development of the present invention is to improve on the defects resided in the conventional structures of signal line, in order to provide 100% obscuring, to minimize the degree of mutual interference, to increase the strength of the signal line to avoid deformation of the structure of the signal line due to bending.

SUMMARY OF THE INVENTION

The primary object of the present invention is to increase the strength of a signal line to avoid deformation of the structure of the signal line due to bending.

The secondary object of the present invention is to minimize the degree of mutual interference and thereby to provide a signal line with 100% obscuring, To achieve the above stated objects, the present invention is comprised of a core portion, a middle filler layer, an obscuring layer and an outer coating portion. The core portion has at least a rectangular conductor which is enveloped by an insulation tape; the obscuring layer has at least a knitted metallic obscuring layer; the outer coating portion has at least a layer made of polyvinyl chloride composition; and the middle filler layer is comprised of a plurality of hollow tubes. The core portion is tangled with the middle filler layer to make the line stronger in addition to being flexible, so that the line will not have the core portion damaged when it is bent to deform, plus the obscuring function of the obscuring layer, the degree of mutual interference can be reduced to the minimum.

The present invention will be apparent after reading the detailed description of the preferred embodiment thereof in reference to the accompanying drawings.

DETAILED DESCRIPTION OF THE PREFERRED EMBODIMENT

Figure 1:
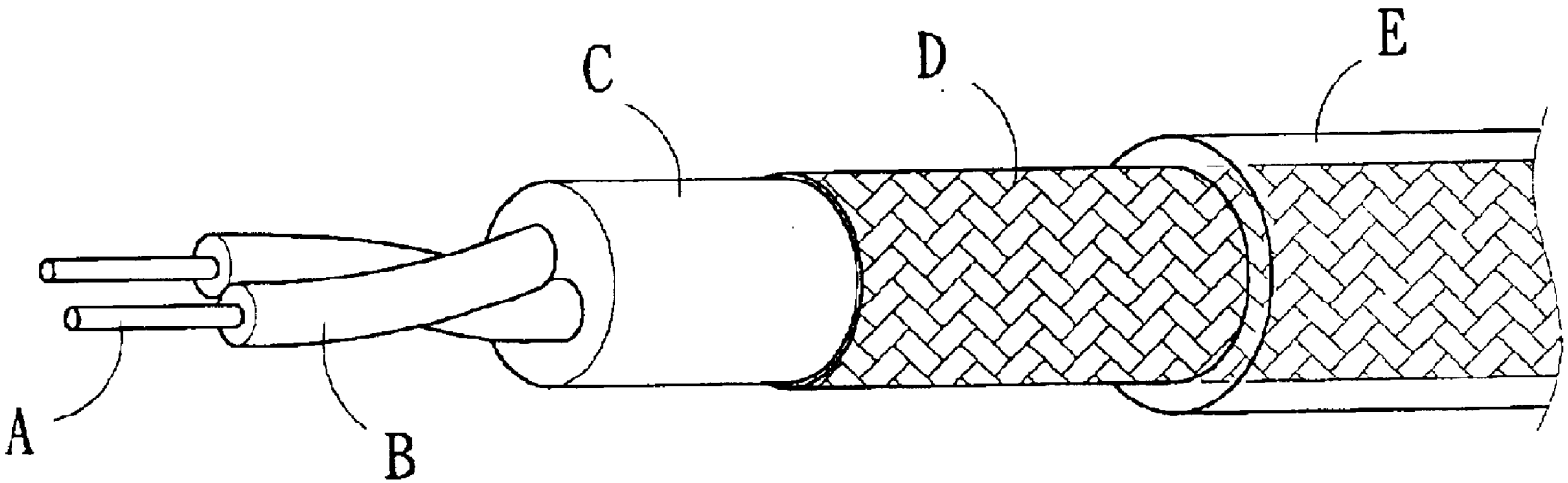
Fig. 1 (Prior Art)
FIG. 1 is an analytic perspective view showing the structure of a conventional signal line.
Figure 2:
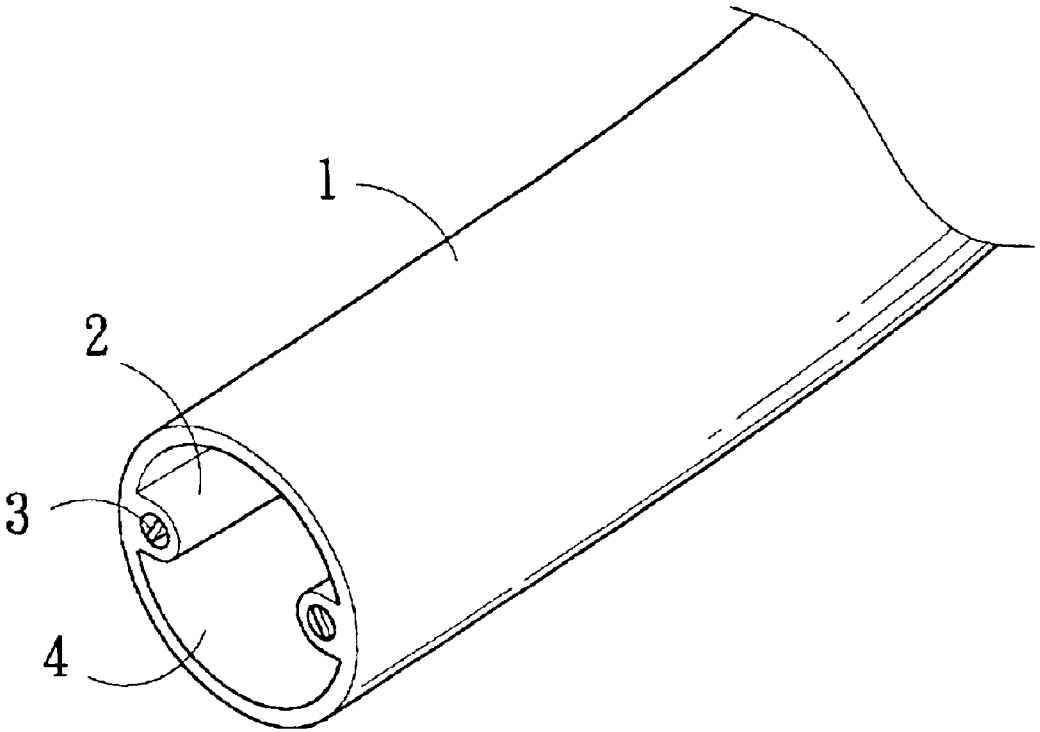
Fig. 2 (Prior Art)
FIG. 2 is a perspective view showing the appearance of another conventional signal line.
Figure 3:
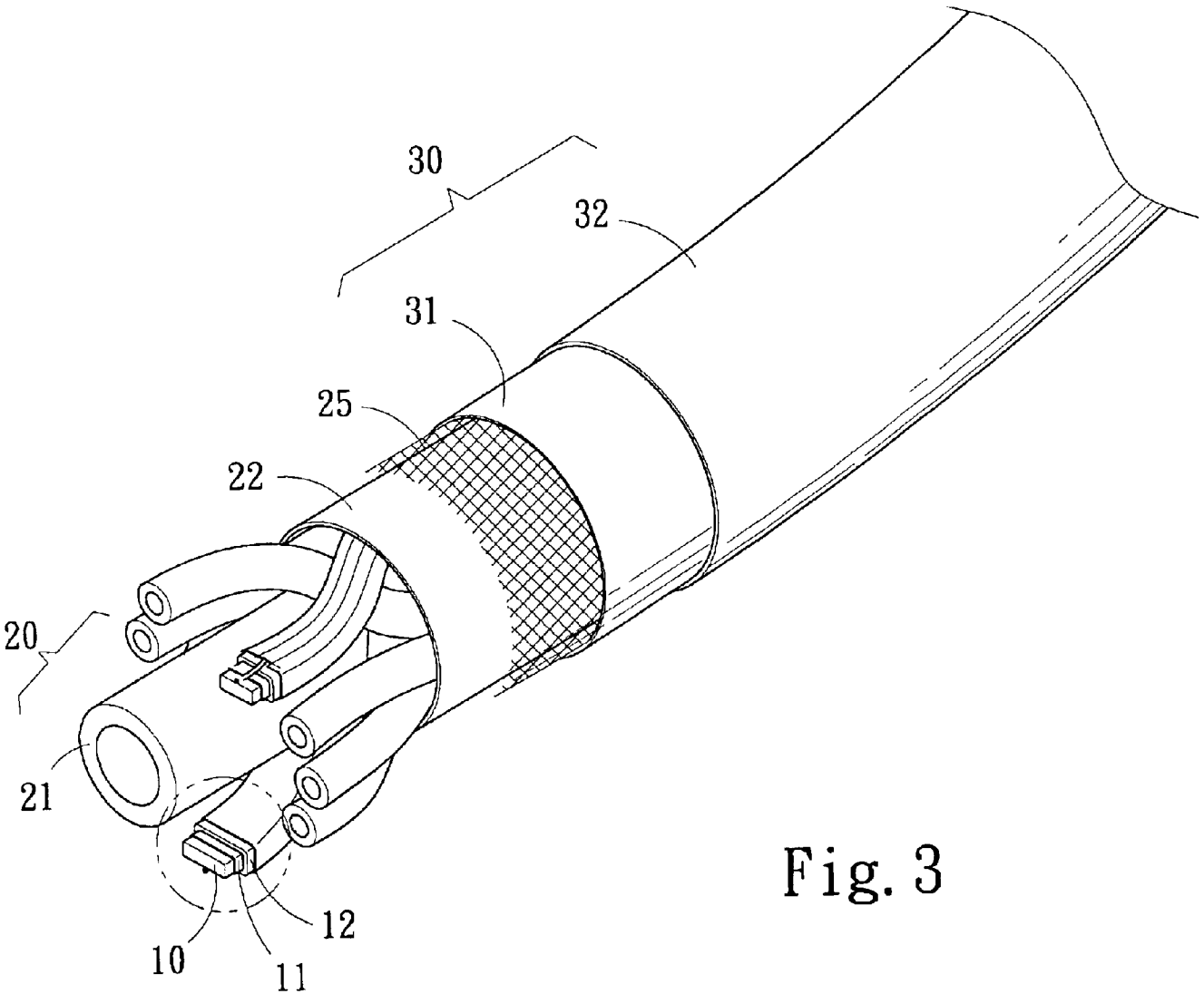
FIG. 3 is an analytical perspective view showing the structure of an embodiment of the present invention.
Figure 4:
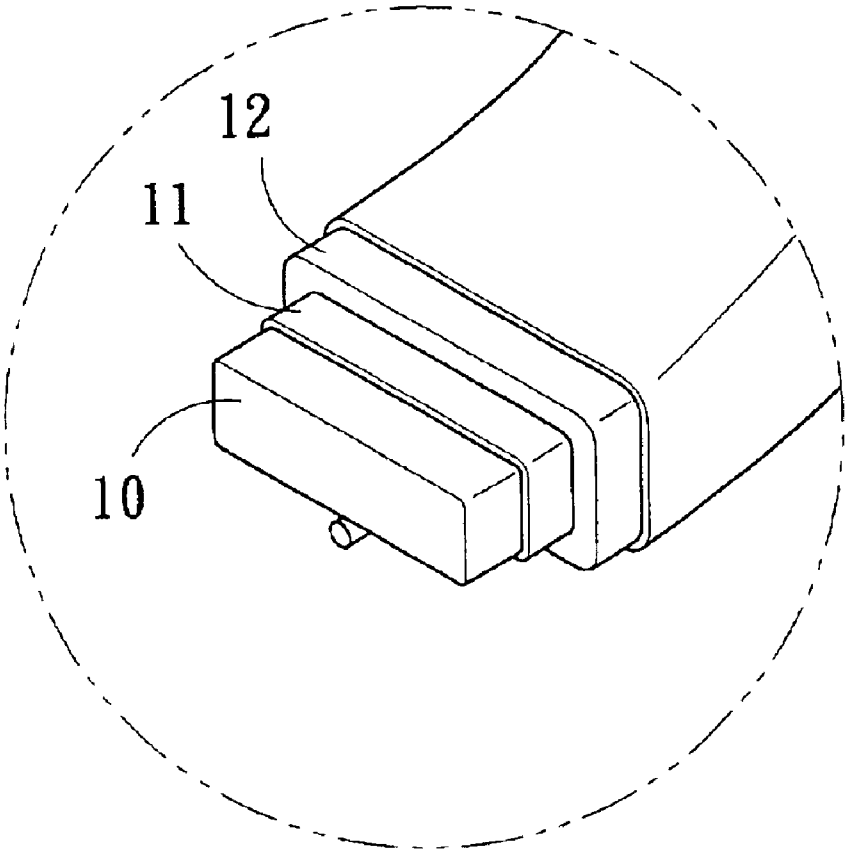
FIG. 4 is an enlarged schematic perspective view of the core portion of the present invention.
Figure 5:
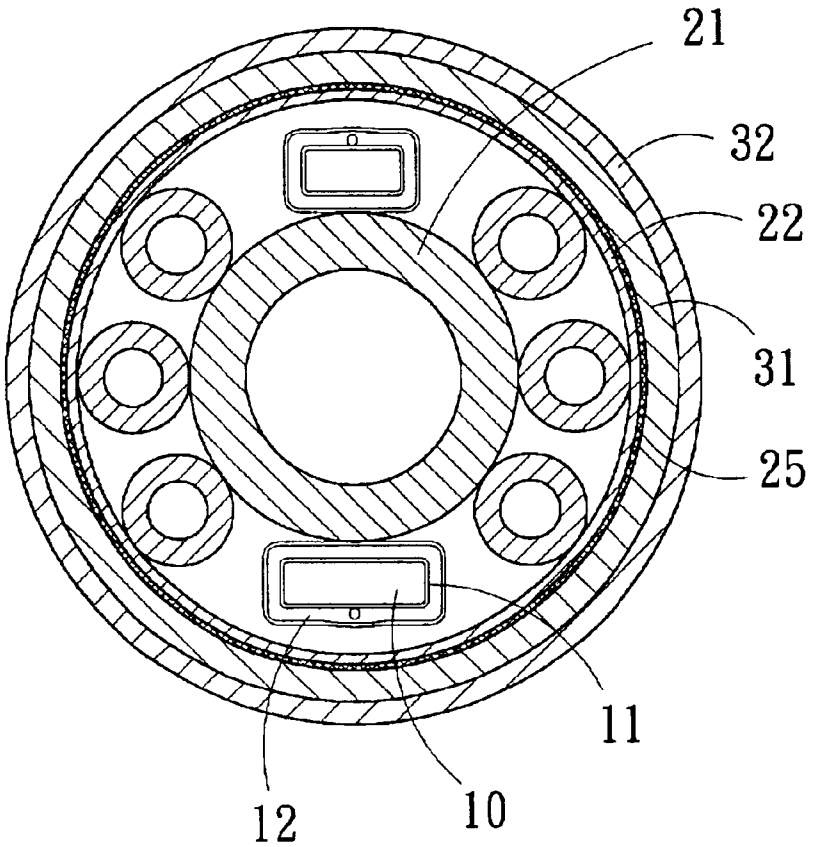
FIG. 5 is a cross-sectional view of the embodiment of the present invention.

Referring firstly to FIG. 3, the present invention is comprised of a core portion 10, a middle filler layer 20, an obscuring layer 25 and a coating portion 30. The core portion 10 is a conductor made of pure copper of single crystal in single direction, in a rectangular shape, and is wrapped up in a wrapping roll made from foamed Teflon (PTFE) tape. The preferred embodiment uses a twin layer wrapping roll including an inner layer 11 and an outer layer 12, and then uses an outermost metallic tape for wrapping up, such as is shown in FIG. 4. Further, the cross section of the positive pole in the core portion 10 is smaller than that of the negative pole. The middle filler layer 20 is made from a plurality of hollow tubes, one of the hollow tubes is a larger volume hollow tube 21, an outer metallic wrapping roll 22 envelops the hollow tubes, and the obscuring layer 25 envelops the metallic wrapping roll 22, the obscuring layer 25 is a knitted metallic net. The coating portion 30 is made of polyvinyl chloride (PVC) composition and is divided into a first coating layer 31 and a second coating layer 32.

The larger volume hollow tube 21 of the middle filler layer 20 and the small hollow tubes are placed in the core portion 10, and are twisted in an identical direction (clockwise or counterclockwise), then the outer metallic wrapping roll 22 is used to envelop the middle filler layer 20 and the core portion 10, these are enveloped by the knitted metallic net-like obscuring layer 25, and finally, the first coating layer 31 and the second coating layer 32 of the coating portion 30 are used to sequentially envelop the knitted metallic net-like obscuring layer 25 to complete the structure of the present invention.

The conductor made of pure copper of single crystal in single direction can be coated with lacquer to prevent the conductor from oxidation. And more, the dielectric coefficient of the Teflon in the inner layer 11 and the outer layer 12 made from foamed Teflon (PTFE) tapes is largest, hence these layers 11, 12 get an excellent insulation effect, and the degree of mutual interference can be reduced to the minimum; plus the 100% obscuring effect provided by the multi-layer obscuring of the outer metallic wrapping roll 22, the knitted metallic net-like obscuring layer 25, the large volume hollow tube 21 and the middle filler layer 20 etc., the interference among a magnetic field, radio frequencies and static electricity can be effectively reduced, thereby, attenuation rate of the line can be reduced, distortion of the line can be smaller, and high quality of the line can be obtained. Moreover, the cross section of the positive pole in the core portion 10 is smaller than that of the negative pole; therefore, when a loop is formed, signals transmitted under a fast speed from the positive pole core component with a smaller cross-sectional area to the negative pole core component will not be jammed to influence the quality of transmission.

And more, the middle filler layer 20 and the core portion 10 are twisted in an identical direction, so that in any section of the signal line, as shown in FIG. 4, the core components of the core portion 10 can be kept parallel to each other without mutual interference; and the core portion 10 is entangled with the middle filler layer 20, this reinforces the signal line and increases the flexibility of the signal line, so that the signal line will not deform during bending to damage the core portion 10.

Accordingly, the structure of the present invention has the following practical advantages:

1. In comparison of the rectangular core components with the conventional round core components having the same cross-sectional areas, the surface area of the rectangular core components is larger than that of the conventional round core components, thereby, the transmission area of the rectangular core components is increased, this can lower the attenuation of and increase the speed of signal transmission.
2. The dielectric coefficient of the Teflon in the wrapping roll made from foamed Teflon (PTFE) tapes over the core components is largest, hence an excellent insulation effect can be obtained, and the degree of mutual interference can be reduced to the minimum;
3. The core portion and the hollow tubes of the middle filler layer are twisted in an identical direction; this reinforces the signal line and increases the flexibility of the signal line, so that the signal line will not deform during bending to damage the core portion, and the core components of the core portion can be kept parallel to each other.

The structure of signal line of the present invention can have an effect of efficiently obscuring by providing the core portion and the obscuring layer, thereby can effectively prevent interference among a magnetic field, radio frequencies and static electricity; such a signal line is surely brand-new as compared to the lines available presently, functional improvement thereof is evident.

Having thus described the invention with industrial value, what I claim as new and desire to be secured by Letters Patent of the United States are:

1. A structure of signal line comprising a core portion, a middle filler layer, an obscuring layer and a coating portion, whereof, said core portion has a rectangular cross section and is a conductor of high transmission speed; said obscuring layer is a knitted metallic obscuring layer; said coating portion has at least a layer for enveloping as an outermost layer; said middle filler layer is comprised of a plurality of hollow tubes and an outer metallic wrapping roll and is provided between said core portion and said coating portion, said hollow tubes are entangled with said core portion.

2. The structure of signal line as in claim 1, wherein, said core portion is made of pure copper of single crystal in single direction, and is coated with anti-oxidation lacquer to form a conductor of pure copper of single crystal in single direction coated with lacquer.

3. The structure of signal line as in claim 2, wherein, said core portion is wrapped up in a wrapping roll made from foamed PTFE tape or an outermost metallic tape.

4. The structure of signal line as in claim 1, wherein, one of said hollow tubes of said middle filler layer is a larger volume hollow tube, said outer metallic wrapping roll of said middle filler layer is made from a copper foil.

5. The structure of signal line as in claim 1, wherein, said coating portion is made of a polyvinyl chloride (PVC) composition.

* * * * *